US010705449B2

(12) United States Patent
Ishida et al.

(10) Patent No.: US 10,705,449 B2
(45) Date of Patent: Jul. 7, 2020

(54) DEVELOPING MEMBER, ELECTROPHOTOGRAPHIC PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Kazutoshi Ishida, Mishima (JP); Kazuaki Nagaoka, Susono (JP); Minoru Nakamura, Mishima (JP); Ryo Sugiyama, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/695,754

(22) Filed: Nov. 26, 2019

(65) Prior Publication Data

US 2020/0174397 A1 Jun. 4, 2020

(30) Foreign Application Priority Data

Nov. 30, 2018 (JP) ..... 2018-224643
Nov. 13, 2019 (JP) ..... 2019-205511

(51) Int. Cl.
*G03G 15/08* (2006.01)

(52) U.S. Cl.
CPC ..... *G03G 15/0808* (2013.01); *G03G 15/0818* (2013.01)

(58) Field of Classification Search
CPC ..... G03G 15/0806; G03G 15/0818
USPC ..... 399/286
See application file for complete search history.

(56) References Cited

U.S. PATENT DOCUMENTS 7,727,134 B2 6/2010 Nakamura et al.
7,797,833 B2 9/2010 Nakamura et al.
7,798,948 B2 9/2010 Kawamura et al.
7,799,398 B2 9/2010 Nakamura et al.
8,655,222 B2 2/2014 Nakamura et al.
8,655,238 B2 2/2014 Uno et al.
8,660,472 B2 2/2014 Kurachi et al.
(Continued)

FOREIGN PATENT DOCUMENTS

JP H04-88381 3/1992
JP H05-72889 3/1993
(Continued)

OTHER PUBLICATIONS

U.S. Appl. No. 16/540,463, Noriyuki Doi, Aug. 14, 2019.
(Continued)

*Primary Examiner* — William J Royer
(74) *Attorney, Agent, or Firm* — Venable LLP

(57) ABSTRACT

Provided is a developing member capable of sufficiently securing a toner conveyance amount, thereby being capable of suppressing a reduction in image density, even when a solid black image or an image having a high print percentage is continuously output. The developing member includes an electro-conductive substrate and an electro-conductive layer thereon, an outer surface of the developing member includes a first, second and third regions, when surface potentials of the respective regions with scanning probe microscope, and measured surface potential of the respective regions are defined as V1, V2, and V3, respectively, V1 is −0.70 V to −0.50 V, 1.30≤V1/V2≤25.00, and V3 is 0.00 V to 0.50 V.

8 Claims, 8 Drawing Sheets

(56) References Cited

U.S. PATENT DOCUMENTS

| | | | |
|---|---|---|---|
| 8,745,870 | B2 | 6/2014 | Kawamura et al. |
| 8,768,227 | B2 | 7/2014 | Urushihara et al. |
| 8,798,508 | B2 | 8/2014 | Yamada |
| 8,837,985 | B2 | 9/2014 | Ishida et al. |
| 8,846,287 | B2 | 9/2014 | Yamada et al. |
| 8,874,007 | B2 | 10/2014 | Kawamura et al. |
| 9,017,239 | B2 | 4/2015 | Ishida et al. |
| 9,482,986 | B2 | 11/2016 | Sakurai et al. |
| 9,625,854 | B2 | 4/2017 | Koyanagi et al. |
| 9,846,407 | B2 | 12/2017 | Nakamura et al. |
| 9,921,518 | B2 | 3/2018 | Sakurai et al. |
| 9,952,531 | B2 | 4/2018 | Ishii et al. |
| 9,952,532 | B2 | 4/2018 | Sugiyama et al. |
| 10,082,741 | B2 | 9/2018 | Ishida et al. |
| 10,310,447 | B2 | 6/2019 | Morishita et al. |
| 10,539,891 | B1 | 1/2020 | Ishii et al. |
| 2013/0130022 | A1 | 5/2013 | Uesugi et al. |
| 2013/0164038 | A1 | 6/2013 | Kusaba et al. |
| 2013/0266339 | A1 | 10/2013 | Sugiyama et al. |
| 2017/0139336 | A1 | 5/2017 | Nagaoka et al. |
| 2019/0265609 | A1 | 8/2019 | Sakurai et al. |
| 2019/0324382 | A1 | 10/2019 | Sugiyama et al. |
| 2020/0041921 | A1 | 2/2020 | Yamaguchi et al. |
| 2020/0041926 | A1 | 2/2020 | Ishida et al. |
| 2020/0041927 | A1 | 2/2020 | Urushihara et al. |
| 2020/0041928 | A1 | 2/2020 | Tsuru et al. |

FOREIGN PATENT DOCUMENTS

| | | |
|---|---|---|
| JP | 2002-049221 | 2/2002 |
| JP | 2003-005504 | 1/2003 |
| JP | 2009-169097 | 7/2009 |
| JP | 2011-048007 | 3/2011 |
| JP | 2013-174808 | 9/2013 |

OTHER PUBLICATIONS

U.S. Appl. No. 16/541,732, Kazuhito Wakabayashi, Aug. 15, 2019.
U.S. Appl. No. 16/545,434, Kenta Matsunaga, Aug. 20, 2019.
U.S. Appl. No. 16/569,768, Fumihiko Utsuno, Sep. 13, 2019.
U.S. Appl. No. 16/672,770, Wataru Moriai, Nov. 4, 2019.

DEVELOPING MEMBER, ELECTROPHOTOGRAPHIC PROCESS CARTRIDGE, AND ELECTROPHOTOGRAPHIC IMAGE FORMING APPARATUS

BACKGROUND OF THE INVENTION

Field of the Invention

The present disclosure relates to a developing member to be used for an electrophotographic image forming apparatus, and to an electrophotographic process cartridge and an electrophotographic image forming apparatus each including the developing member.

Description of the Related Art

A developing roller to be used for a developing apparatus of an electrophotographic image forming apparatus (hereinafter sometimes referred to as electrophotographic apparatus) is required to stabilize a toner conveyance amount.

In Japanese Patent Application Laid-Open No. H05-72889, there is a disclosure of a developing apparatus including a developing roller (developer carrying member) in which at least a surface of the developing roller has a continuous phase (sea portion) and a discontinuous phase (island portion) that are formed by blending two or more different kinds of amorphous polymers and then molding the blended polymers.

In Japanese Patent Application Laid-Open No. H04-88381, there is a disclosure of a developing roller having an elastic surface layer formed of an electro-conductive elastomer, in which insulating particles are dispersed at least in the vicinity of a surface thereof, and part of the particles are exposed on the surface.

According to an investigation made by the inventors of the present invention, when a solid black image or an image having a high print percentage was continuously output with the developing roller described in Japanese Patent Application Laid-Open No. H05-72889 or Japanese Patent Application Laid-Open No. H04-88381, a toner conveyance amount of the developing roller was reduced, with the result that a density of an electrophotographic image was reduced in some cases.

SUMMARY OF THE INVENTION

One aspect of the present disclosure is directed to providing a developing member that hardly shows a reduction in toner conveyance amount even when a solid black image or an image having a high print percentage is continuously output.

Another aspect of the present disclosure is directed to providing an electrophotographic process cartridge conducive to stable formation of a high-quality electrophotographic image.

Still another aspect of the present disclosure is directed to providing an electrophotographic image forming apparatus capable of stably forming a high-quality electrophotographic image.

According to one aspect of the present disclosure, there is provided a developing member including: an electro-conductive substrate; and an electro-conductive layer on the substrate, wherein an outer surface of the developing member includes a first region, a second region, and a third region, wherein, when surface potentials of the first region, the second region, and the third region are measured with a scanning probe microscope provided with a probe by applying a voltage of 4.5 V to the probe under an environment having a temperature of 23° C. and a relative humidity of 50%, the probe being disposed so that distances between the probe and surfaces of the first, the second and the third regions are defined as V1, V2, and V3, respectively, V1 is −0.70 V to −0.50 V V1 and V2 satisfy a relationship of $1.30 \leq V1/V2 \leq 25.00$, and V3 is 0.00 V or more and 0.50 V or less, and wherein the developing member has a portion in which the first region, the second region, and the third region are adjacent to each other in this order.

According to another aspect of the present disclosure, there is also provided an electrophotographic process cartridge to be removably mounted onto a main body of an electrophotographic image forming apparatus, the electrophotographic process cartridge including a developing member, the developing member including the above-mentioned developing member.

According to still another aspect of the present disclosure, there is also provided an electrophotographic image forming apparatus including a developing member, the developing member including the above-mentioned developing member.

Further features of the present invention will become apparent from the following description of exemplary embodiments with reference to the attached drawings.

DESCRIPTION OF THE EMBODIMENTS

Figure 1:
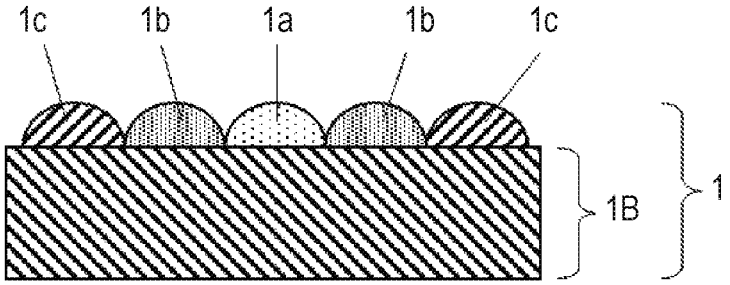
FIG. 1 is an explanatory view (partial cross-sectional view) of a developing member according to one aspect of the present disclosure.

The developing rollers as disclosed in Japanese Patent Application Laid-Open No. H05-72889 and Japanese Patent Application Laid-Open No. H04-88381 are each configured to convey toner by carrying the toner on the outer surface thereof through utilization of a gradient force. That is, through triboelectric charging between the developing roller and the toner or external voltage application, charge accumulates in an insulating portion of the developing roller. In this case, when the insulating portion and an electro-conductive portion are exposed on the outer surface, a potential difference is generated between the insulating portion and the electro-conductive portion. The potential difference forms a minute closed electric field to generate a gradient force. The gradient force is a force to be generated toward the center of the developing roller as cut perpendicularly to its axial direction. The developing rollers according to Japanese Patent Application Laid-Open No. H05-72889 and Japanese Patent Application Laid-Open No. H04-88381 are each configured to convey toner onto a photosensitive drum by attracting the toner to the outer surface thereof with the gradient force.

The developing roller configured to carry toner on its outer surface through use of the gradient force can stably carry and convey a sufficient amount of a developer on its outer surface. However, according to an investigation made by the inventors of the present invention, even with such developing roller, when a solid black image or an image having a high print percentage was continuously output, the conveyance amount of the toner was reduced in some cases.

In view of the foregoing, the inventors of the present invention have made investigations in order to further improve the toner conveyance amount.

As a result, the inventors have found that a developing member having in its outer surface a portion in which a first, a second and a third regions different from each other in electro-conductivity are adjacent to each other in this order can well achieve the above-mentioned object. When such developing member has a voltage applied thereto or is subjected to friction with toner, by virtue of the arrangement of the first to third regions different from each other in amount of charge to be accumulated therein on the outer surface, differences in surface potential can be generated between the regions. As a result, gradient forces are generated at a boundary between the first region and the second region, and a boundary between the second region and the third region. That is, as compared to the developing rollers according to Japanese Patent Application Laid-Open No. H05-72889 and Japanese Patent Application Laid-Open No. H04-88381, gradient force generation sites are increased. As a result, a larger amount of toner can be attracted to the outer surface, and hence even when a solid black image or an image having a high print percentage is output, the reduction in toner conveyance amount can be prevented or suppressed.

Now, a developing member according to one aspect of the present disclosure is described in detail.

The outer surface of the developing member includes a first region (first insulating portion), a second region (second insulating portion), and a third region (electro-conductive portion). The surface potentials of the regions when a voltage is applied with a scanning probe microscope provided with a probe under certain conditions have the following relationship.

That is, surface potentials of the first region, the second region, and the third region are measured by applying a voltage of 4.5 V to the probe which is disposed so that distances between the probe and surfaces of the respective regions are 90 nm under an environment having a temperature of 23° C. and a relative humidity of 50%, and the measured surface potentials of the first region, the second region, and the third region are defined as V1, V2, and V3, respectively. In such case, V1 is −0.70 V or more and −0.50 V or less, V1 and V2 satisfy a relationship of $1.30 \leq V1/V2 \leq 25.00$, and V3 is 0.00 V or more and 0.50 V or less.

The magnitude relationship of V1, V2, and V3 is as follows: V1 is larger than V2 in terms of absolute value, and the values of V1 and V2 are negative values. Meanwhile, the value of V3 is 0.00 V or a positive value.

When V1, V2, and V3 are set to fall within the above-mentioned ranges, surface potential differences between the first region, the second region, and the third region are generated to generate minute closed electric fields between the regions to generate a gradient force at each boundary. That is, surface potential differences are generated between the first region and the second region, and between the second region and the third region to generate gradient forces between the regions. In addition, when the first region and the third region are adjacent to each other, a gradient force is generated between the first region and the third region. As compared to the conventional generation site of a gradient force generated only between an insulating portion and an electro-conductive portion, gradient forces can be generated in a multistage manner, and hence generation sites can be increased. As a result, the toner conveyance amount can be increased.

The developing member needs to have a portion in which the first region, the second region, and the third region are adjacent to each other in this order as seen from the surface of the developing member. When such configuration is adopted, gradient forces can be generated at boundaries between the regions. Not all the periphery of the first region needs to be adjacent to the second region, and part of the first region may be adjacent to the third region. In addition, the first region, the second region, and the third region only need to be adjacent to each other in the stated order, and may be formed without any particular limitations on, for example, the upper and lower relationship of the heights of the regions and the arrangement positions thereof. In addition, the regions may be arranged in parallel.

Specific configurations are described with reference to FIG. 1, which is a partial cross-sectional view of a developing member according to one aspect of the present disclosure, FIG. 2A and FIG. 2B, which are a partial cross-sectional view and plan view of a developing member according to another aspect of the present disclosure, and FIG. 3, which is a partial cross-sectional view of a developing member according to still another aspect of the present disclosure.

The developing member illustrated in FIG. 1 has a first region 1*a*, second regions 1*b*, and third regions (hereinafter sometimes referred to as electro-conductive portions) 1*c* on the circumferential surface of an electro-conductive layer 1B. The electro-conductive layer 1B and the third regions 1*c* are separately formed. As a method for the formation, there is given a formation method involving applying a coating material having dissolved therein a material for forming the third regions 1*c* onto the electro-conductive layer 1B by dipping or the like, and causing the material for forming the third regions 1*c* to be repelled on the electro-conductive layer 1B. In addition, the electro-conductive layer 1B and the third regions 1*c* may be formed by a method involving forming the third regions 1*c* on the electro-conductive layer 1B through use of a jet dispenser.

Figure 2A:
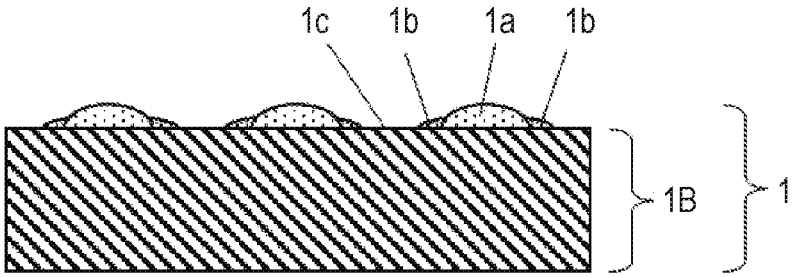
FIG. 2A is a partial cross-sectional view serving as an explanatory view of a developing member according to another aspect of the present disclosure.
Figure 2B:
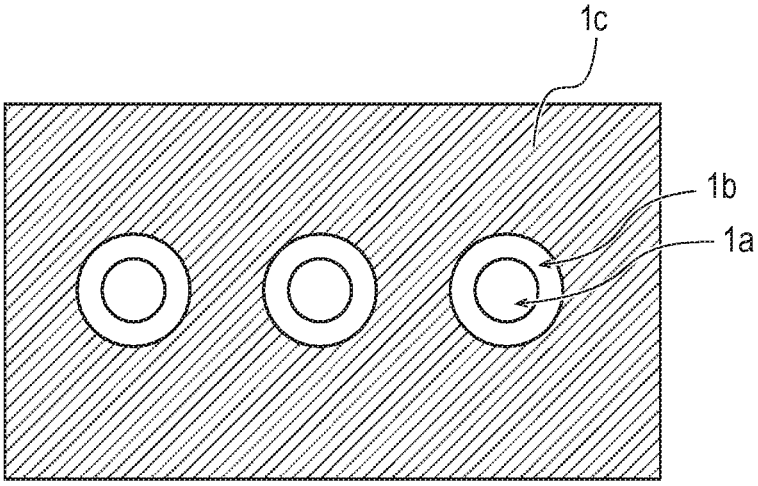
FIG. 2B is a plan view thereof.

As illustrated in FIG. 2A, the developing member illustrated in FIG. 2A and FIG. 2B has the first regions 1*a* and the second regions 1*b* on the outer surface of the electro-conductive layer 1B formed on a substrate (not shown). The exposed portion of the outer surface of the electro-conductive layer 1B, which is not covered with the first regions 1*a* and the second regions 1*b*, serves as the third region 1.

The surface of the electro-conductive layer 1B in FIG. 2A and FIG. 2B may be roughened by adding particles to a material for forming the electro-conductive layer 1B.

Figure 3:
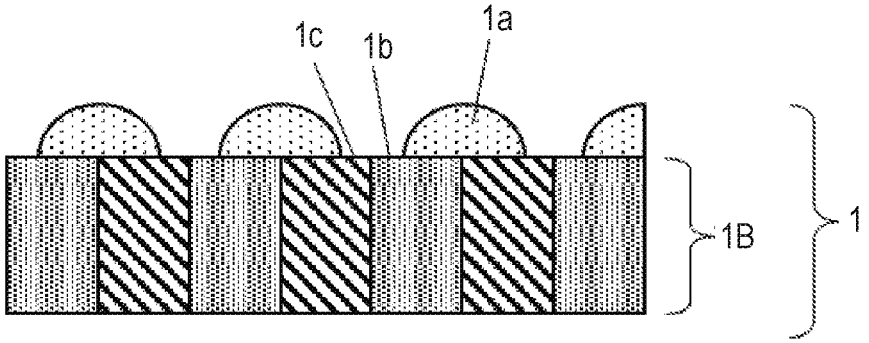
FIG. 3 is a schematic partial cross-sectional view for illustrating an example of a developing member according to the present disclosure.

In the developing member illustrated in FIG. 3, the electro-conductive layer 1B itself, which is arranged on a substrate (not shown), is formed using materials for forming the second region 1*b* and the third region 1*c*. That is, the electro-conductive layer on the outer surface of the substrate has a phase-separated structure including the second region 1*b* and the third region 1*c*. The first regions 1*a* are arranged on such electro-conductive layer 1B so that at least part of each of the second region 1*b* and the third region 1*c* of the electro-conductive layer 1B may form the outer surface of the developing member. From the viewpoint of securing electro-conductivity of the developing member, it is preferred that, out of the second region 1*b* and the third region 1*c* forming the electro-conductive layer 1B, the third region 1*c* be a continuous phase.

<Developing Member>

The developing member may be used as a member for electrophotography in an electrophotographic apparatus, such as a printer. In addition, the developing member according to the present disclosure may be particularly suitably used as a roller for electrophotography, such as a developing member having a roller shape (developing roller). The developing member according to the present disclosure is hereinafter described with a main focus on the developing roller, but its use is not limited to the developing roller. As described above, in the present disclosure, as long as the developing member has a portion in which the first region, the second region, and the third region are adjacent to each other in the stated order as seen from the surface of the developing member, the regions may be formed without any particular limitations on, for example, the arrangement positions and parallel arrangement of the regions.

Figure 4A:
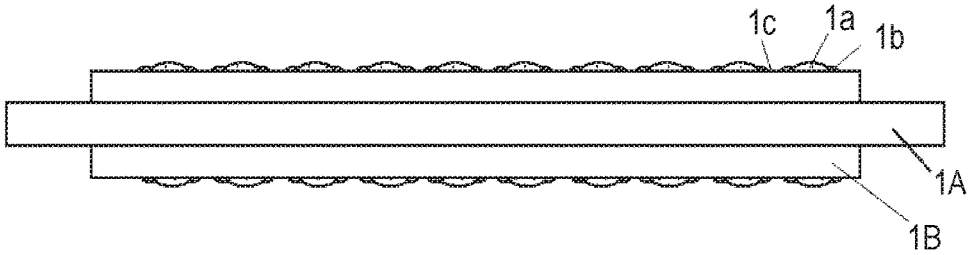
FIG. 4A is a cross-sectional view parallel to the axial direction of a substrate in a schematic cross-sectional view of an example of a developing member having a roller shape according to the present disclosure.
Figure 4B:
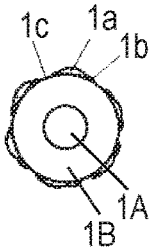
FIG. 4B is a cross-sectional view perpendicular to the axial direction of the substrate.
Figure 5A:
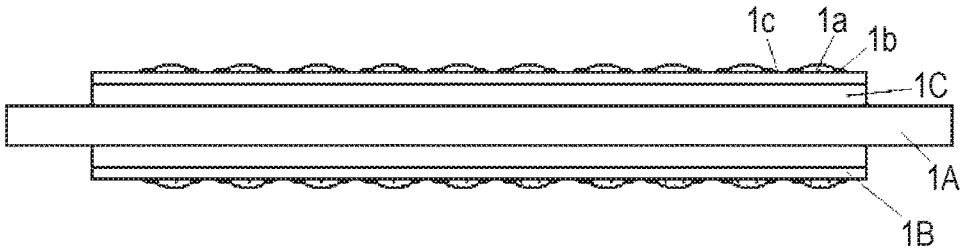
FIG. 5A is a cross-sectional view parallel to the axial direction of a substrate in a schematic cross-sectional view of another example of the developing member having a roller shape according to the present disclosure.
Figure 5B:
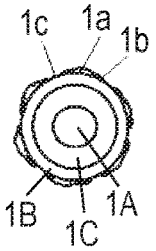
FIG. 5B is a cross-sectional view perpendicular to the axial direction of the substrate.

FIG. 4A and FIG. 4B, and FIG. 5A and FIG. 5B are cross-sectional views of two examples of the developing member having a roller shape (hereinafter sometimes referred to as "developing roller") according to one aspect of the present disclosure. FIG. 4A and FIG. 5A are cross-sectional views of the developing member as cut parallel to the axial direction of a substrate 1A, and FIG. 4B and FIG. 5B are cross-sectional views of the developing member as cut perpendicularly to the axial direction of the substrate 1A. As illustrated in FIG. 4A and FIG. 4B, a developing member according to a first embodiment includes the electro-conductive substrate 1A and the electro-conductive layer 1B, which serves as the third region 1*c*, arranged on the outer peripheral surface of the substrate (on the substrate). The first regions 1*a* and the second regions 1*b* are arranged on the outer peripheral surface of the electro-conductive layer 1B (on the electro-conductive layer). The second regions are formed on the outer edges of the first regions. When the configuration of FIG. 4A and FIG. 4B is adopted, the first region, the second region, and the third region are adjacent to each other. Besides, the number of sites adjacent in the stated order is easily controlled and the adjacent sites can be increased, and hence gradient force generation sites can be increased.

In addition, a developing member according to a second embodiment may further include one or more other layers (e.g., other elastic layers) arranged between the third region (electro-conductive layer) 1*c* and the electro-conductive substrate 1A as required. In FIG. 5A and FIG. 5B, an inner layer 1C serving as another elastic layer is arranged between the electro-conductive layer 1B and the substrate 1A.

In each of the developing members according to those embodiments, the first regions 1*a* and the second regions 1*b* cover part of the surface of the electro-conductive layer 1B serving as the third region 1*c*. In FIG. 4A and FIG. 4B, and FIG. 5A and FIG. 5B, the first regions 1*a* and the second regions 1*b* are arranged on the electro-conductive layer 1B in its circumferential direction and axial direction (longitudinal direction), the first regions 1*a* are scattered on the outer surface of the developing member, and the second regions 1*b* are formed on the outer edges of the first regions 1*a*. In other words, the surface of the developing member includes the surfaces of the first regions and the second regions, and the third region that is the electro-conductive layer surface that is not covered with the first regions and the second regions.

That the outer surface of the developing member includes those surface portions may be confirmed by the following method. That is, confirmation may be performed by subjecting the outer surface of the developing member to the observation of a portion having a high potential (portion in which charge accumulates) and a portion having a low potential (electro-conductive layer portion) with a scanning probe microscope (more specifically, a Kelvin force microscope (KFM)).

In addition, the presence of the first region and the second region may be further confirmed by the following method. That is, for each of 10 randomly selected sites on the developing member, a transition of surface potential for 10 seconds from immediately after the application of a voltage (of, for example, −8 kV) is measured (for example, at intervals of 0.05 seconds), and the retention rate of the surface potential at each time at each measurement point is determined from the following equation. Then, when the average value of the retention rates after 10 seconds at the 10 randomly selected sites is 10% or more, it can be confirmed that a region in which charge accumulates is present as a surface portion of the developing member.

$$\text{Retention rate at each measurement point (\%)} = \{\text{surface potential at each time } (V)/\text{initial surface potential } (V)\} \times 100$$

The volume resistivity of a compound for forming the first region is $1.0\times10^{13}$ Ω·cm or more and $1.0\times10^{18}$ Ω·cm or less. The volume resistivity of a compound for forming the second region is preferably set to be lower than that of the first region, and is more preferably $1.0\times10^{11}$ Ω·cm or more and $5.0\times10^{12}$ Ω·cm or less. Further, the volume resistivity of the electro-conductive layer serving as the third region is preferably set to be lower than that of the second region, and is more preferably $1.0\times10^{10}$ Ω·cm or less.

Now, each constituent member of the developing member is described in more detail.

(Electro-Conductive Substrate)

When the electro-conductive substrate (hereinafter sometimes referred to as mandrel or substrate) is used for the developing member, such as the developing roller, any substrate that functions as an electrode for the developing member and as a member configured to support the electro-conductive layer and the like may be appropriately used. The shape of the substrate is not particularly limited, and a hollow cylindrical or solid columnar substrate may be appropriately used. In addition, as a material for the substrate, for example, a metal or alloy, such as aluminum, copper, stainless steel, or iron, or an electro-conductive material, such as an electro-conductive synthetic resin, may be used. Further, a known adhesive may be appropriately applied to the surface of the substrate for the purpose of improving an adhesive property with the electro-conductive layer to be arranged on the outer peripheral surface thereof.

(Electro-Conductive Layer)

The third region is preferably formed of part of the surface of the electro-conductive layer on the opposite side to the side opposed to the electro-conductive substrate. In other words, it is preferred that, as illustrated in FIG. 2A and FIG. 2B, the electro-conductive layer 1B be arranged on the circumferential surface of the substrate, the first regions 1*a* and the second regions 1*b* be arranged on the opposite side to the side opposed to the substrate 1A, i.e., on the outer surface of the electro-conductive layer 1B, and a portion of the outer surface of the electro-conductive layer 1B that is not covered with the first regions 1*a* and the second regions 1*b* (exposed portion) serve as the third region 1*c*.

When the first region and the second region are formed on the outer surface of the electro-conductive layer, and the exposed portion of the outer surface of the electro-conductive layer serves as the third region, gradient force generation sites are increased. Consequently, not only the toner conveyance amount is easily secured, but also electro-conductivity is easily secured as a developing member, and hence the electro-conductivity of the developing member is easily controlled.

The electro-conductive layer is a layer having elasticity so as to form an appropriate nip with a photosensitive member, and a known rubber material or resin may be used as a material therefor. Examples of the rubber material include an ethylene-propylene-diene copolymerized rubber (EPDM), an acrylonitrile-butadiene rubber (NBR), a chloroprene rubber (CR), a natural rubber (NR), an isoprene rubber (IR), a styrene-butadiene rubber (SBR), a fluororubber, a silicone rubber, an epichlorohydrin rubber, a butadiene rubber (BR), a hydrogenated product of NBR, a polysulfide rubber, and a urethane rubber. For the electro-conductive layer, those rubbers may be used alone or as a mixture of a plurality of kinds thereof.

In addition, examples of the resin include a fluororesin, a polyamide resin, an acrylic urethane resin, a phenol resin, a melamine resin, a silicone resin, a urethane resin, a polyester resin, a polyvinyl acetal resin, an epoxy resin, a polyether resin, an amino resin, an acrylic resin, a urea resin, and mixtures thereof. Of those, a urethane resin is preferred from the viewpoint of being excellent in mechanical strength, and the viewpoint of being flexible and having tackiness that facilitates adhesion with the compounds respectively forming the first region and the second region.

For the urethane resin to be used for the electro-conductive layer, a known material may be appropriately used, and for example, monomers for forming the urethane resin (e.g., an isocyanate and a polyol), or a prepolymer may be used.

When the volume resistivity of the rubber or resin to be used in the electro-conductive layer is high, an electro-conductive agent needs to be blended into the electro-conductive layer in order to secure electro-conductivity. An example of the electro-conductive agent is carbon black. Examples of the carbon black may include: carbon black having high electro-conductivity, such as EC300J and EC600JD (both of which are product names, manufactured by Lion Corporation); carbon black for a rubber having a medium degree of electro-conductivity; and carbon black for a coating material.

Of those carbon blacks, carbon black for a coating material is preferably used from the viewpoints of dispersibility and electro-conductivity control. The content (blending amount) of the carbon black in the electro-conductive layer is preferably set to 3 mass % or more from the viewpoint of imparting electro-conductivity and to 50 mass % or less from the viewpoint of rubber elasticity, with respect to 100 mass % of the total of resin components (such as the urethane resin and a second resin to be described later).

In addition, examples of the electro-conductive agent other than those described above include: graphite; various electro-conductive metals or alloys, such as aluminum, copper, tin, and stainless steel; metal oxides each obtained by subjecting tin oxide, zinc oxide, indium oxide, titanium oxide, a tin oxide-antimony oxide solid solution, or the like to any of various treatments for imparting electro-conductivity; and various ionic electro-conductive materials.

Further, the electro-conductive layer may contain other additives in addition to the electro-conductive agent, such as the carbon black. Examples of the other additives include: spherical resin particles for forming unevenness on a surface; a reinforcing material; a surface modifier; and a charge control agent.

When, as illustrated in FIG. 5A and FIG. 5B, the developing member includes the inner layer 1C to be described later between the electro-conductive substrate 1A and the electro-conductive layer 1B, the thickness of the electro-conductive layer 1B serving as the outermost layer of electro-conductive layers is preferably 4 μm or more and 50 μm or less, more preferably 5 μm or more and 45 μm or less. When the thickness of the electro-conductive layer is set to 4 μm or more, contamination of the photosensitive drum or the like by bleeding of a low-molecular-weight component in the inner layer can be prevented, and the electro-conductive layer can be prevented from being peeled off. In addition, when the thickness of the electro-conductive layer is set to 50 μm or less, the surface hardness of the developing member can be kept to a moderate hardness, and toner deterioration can be prevented. In this case, the thickness of the inner layer is preferably 1.0 mm or more from the viewpoint of having contact with the photosensitive drum with an appropriate area, and 5.0 mm or less from the viewpoint of cost.

In addition, when the developing member does not include the inner layer and includes only one electro-conductive layer, the thickness of the electro-conductive layer 1B is preferably 1 mm or more from the viewpoint of having contact with the photosensitive drum with an appropriate area.

(Second Region)

The second region is preferably formed of a metal oxide present on the surface of the electro-conductive layer on the opposite side to the side opposed to the substrate. In other words, the electro-conductive layer is arranged on the circumferential surface of the substrate, and the second region formed of the metal oxide is arranged on the opposite side to the substrate side, i.e., on the surface of the electro-conductive layer. In addition, it is preferred that the second region cover part of the electro-conductive layer to form part of the outer surface of the developing member. Further, it is more preferred that an uncovered portion of the electro-conductive layer constitutes the third region. The case in which the uncovered portion of the electro-conductive layer serves as the third region is preferred because, as compared to, for example, a configuration in which the second region and the third region are arranged in parallel, the number of portions at which the second region and the third region are adjacent to each other and the area thereof are easily controlled, and hence gradient force generation sites can be increased. The reason why the metal oxide is preferably used is described later.

In the case where the second region is arranged on the electro-conductive layer, when the second region is caused to be present on the outer edge of the first region, the first region and the second region, and the second region and the third region are adjacent to each other to generate surface potential differences between the regions, and thus gradient force generation sites can be increased.

For example, on the condition that the second region is present on the outer edge of the first region, the second region may be formed to have such an area as to be scattered on the electro-conductive layer, or the second region may be formed to have such a large area that the electro-conductive layer is slightly exposed.

In addition, the second region does not need to be present across the entire region of the outer edge of the first region, and the following is permitted: the second region is absent on part of the outer edge of the first region, and the third region is present on the outer edge of the first region.

In addition, as a configuration different from FIG. 2A and FIG. 2B, for example, a configuration in which the compound for forming the second region is present between the electro-conductive layer and the first region may be adopted on the condition that the second region is present on the outer edge of the first region. Alternatively, on the condition that the second region is present on the outer edge of the first region and the first region is exposed, a configuration in which the compound for forming the second region is present on the layer of the first region may be adopted.

Any material may be used for the second region without any particular limitation as long as the surface potential of the compound for forming the second region is lower than the surface potential of the compound for forming the first region. As a resin, a thermoplastic resin, a thermosetting resin, a UV-curable resin, or the like may be used without any particular limitation. Specific examples thereof include a urethane resin, an acrylic resin, polyethylene, polypropylene, a polyester resin, a fluororesin, an epoxy resin, a silicone resin, polystyrene, a polystyrene-acrylic resin copolymer, polyarylate, and polycarbonate. In addition, examples of the metal oxide may include silicon oxide, titanium oxide, zinc oxide, strontium titanate, aluminum oxide, magnesium oxide, copper oxide, and tin oxide.

The second region is preferably constituted by a metal oxide particle(s). When metal oxide particles having a small particle diameter are used, the metal oxide particles are easily aggregated, and hence can form the second insulating portion as an aggregate. In addition, when a compound having a high volume resistivity is selected as the compound to be used for the first region and the metal oxide particle is used as the material for forming the second region, the volume resistivity of the second region can be lower. Then, a gradient force can be generated at each of the boundaries with the first region and the third region. Further, in the formation of the second region on the third region, the second region is easily formed under a state in which the electro-conductive layer is exposed (third region).

Further, from the viewpoints of having a high volume resistivity and accumulating charge, the following metal oxide particles are preferably used. That is, silicon oxide particles, titanium oxide particles, zinc oxide particles, and strontium titanate particles may be used.

The particle diameter of the metal oxide particles to be used is preferably 1 μm or less. When the particle diameter is set to 1 μm or less, the metal oxide particles aggregate with each other to form an aggregate, and hence are easily formed into the second region, and besides, facilitate adhesion with the electro-conductive layer, with the result that the second region is less liable to be peeled off.

In addition, the coverage ratio of the second region in the outer surface of the developing member is preferably 10% or more and 40% or less. When the coverage ratio is set to fall within this range, gradient forces are efficiently generated at the boundary with the first region and the boundary with the third region during the use of the developing member, and toner can be satisfactorily conveyed by virtue of the gradient forces.

The shape of the second region is not particularly limited.

Further, the average height of the second regions (average thickness from the surface of an insulating cover portion) is preferably 0.5 μm or more and 10 μm or less. When the average height is set to fall within this range, gradient forces are efficiently generated during the use of the developing member, and toner can be satisfactorily conveyed by virtue of the gradient forces.

The coverage ratio and average height (height) of the second regions may be measured by the following methods. That is, with regard to the coverage ratio, through use of an optical microscope, the coverage area ratio of the second region in each of images observed at 30 randomly selected sites is determined, and the average value of the determined coverage area ratios is calculated as the coverage ratio. In addition, with regard to the average height, through use of a scanning electron microscope, the heights of 30 randomly selected second regions (30 sites) are measured, and the average value thereof is defined as the average height. In the measurement of the heights of insulating portions, when the surface of the electro-conductive layer has protrusions and depressions, the heights of second regions covering depressions are measured.

(First Region)

The first region may preferably be constituted by an electrically insulating portion on the surface of the electro-conductive layer on the opposite side to the side opposed to the substrate. In other words, the electro-conductive layer is arranged on the circumferential surface of the substrate, and the electrically insulating portion is arranged on the opposite side to the substrate side, i.e., on the surface of the electro-conductive layer. In addition, it is preferred that the electrically insulating portion cover part of the electro-conductive layer to form part of the outer surface of the developing member.

When such configuration is adopted, the surface potential difference between the first region and the second region can be increased, and hence a gradient force can be generated at the boundary between the first region and the second region. The term "electrically insulating" refers to having a volume resistivity of $1.0\times10^{16}$ Ω·cm or more and $1.0\times10^{18}$ Ω·cm or less. The first region is formed so as to be adjacent to the second region. The details of the electrically insulating portion in the present disclosure are described later.

In addition, the electrically insulating portion preferably contains a resin. When such configuration is adopted, an electrically insulating property is further enhanced. Further, when a method of forming the first region involves applying a coating material having dissolved therein a material for forming the first region onto the electro-conductive layer, the use of a resin, which is easily repelled on the electro-conductive layer surface as compared to a metal oxide, facilitates the formation of first regions at a certain interval. As a result, the number of sites adjacent to the second region can be more controlled, with the result that gradient force generation sites can be increased.

In this case, it is preferred that at least part of the first regions to be arranged on the electro-conductive layer be arranged (scattered) on the electro-conductive layer at a certain interval, specifically an interval of 5 μm or more and 300 μm or less. When this interval is adopted, gradient forces are efficiently generated during the use of the developing member, and toner can be satisfactorily conveyed by virtue of the gradient forces.

As illustrated in FIG. 4A and FIG. 4B, and FIG. 5A and FIG. 5B, all the first regions may be arranged on the electro-conductive layer at intervals (e.g., at approximately equal intervals). With this, gradient forces are uniformly generated across the entire surface of the electro-conductive layer, and hence toner can be uniformly conveyed. In this case, as described above, from the viewpoint of efficient generation of gradient forces, the distance between the electrically insulating portions to be arranged on the electro-conductive layer at certain uniform intervals is preferably set to 5 μm or more and 300 μm or less.

In addition, the coverage ratio of the first region in the outer surface of the developing member is preferably 10% or more and 40% or less. When the coverage ratio is set to fall within this range, gradient forces are efficiently generated during the use of the developing member, and toner can be satisfactorily conveyed by virtue of the gradient forces.

The shape of the first region is not particularly limited.

Further, the average height of the first regions (average thickness from the surface of an insulating cover portion) is preferably 0.5 μm or more and 30 μm or less. When the average height is set to fall within this range, gradient forces are efficiently generated during the use of the developing member, and toner can be satisfactorily conveyed by virtue of the gradient forces.

The arrangement interval, coverage ratio, and average height (height) of the first regions may be measured by the following methods. That is, with regard to the arrangement interval, through use of an optical microscope, distances between first regions next to each other are measured at 30 randomly selected sites, and the average value thereof is defined as the arrangement interval. In addition, with regard to the coverage ratio, through use of an optical microscope, the coverage area ratio of the first region in each of images observed at 30 randomly selected sites is determined, and the average value of the determined coverage area ratios is calculated as the coverage ratio. In addition, with regard to the average height, through use of a scanning electron microscope, the heights of 30 randomly selected first regions (30 sites) are measured, and the average value thereof is defined as the average height. In the measurement of the heights of the first regions, when the surface of the electro-conductive layer has protrusions and depressions, the heights of first regions covering depressions are measured.

Any compound may be used for forming the first region without any particular limitation as long as the surface potential thereof is −0.70 V or more and −0.50 V or less. For example, a thermoplastic resin, a thermosetting resin, or a UV-curable resin may be used without any particular limitation. Specific examples thereof include a urethane resin, an acrylic resin, polyethylene, polypropylene, a polyester resin, a fluororesin, an epoxy resin, a silicone resin, polystyrene, a polystyrene-acrylic resin copolymer, polyarylate, and polycarbonate. It is preferred to use a resin having an aromatic structure or an alicyclic structure in the molecule, which can increase the volume resistivity of the first region.

(Inner Layer)

As described above, the developing member may include another layer in addition to the electro-conductive substrate and the electro-conductive layer, and for example, as illustrated in FIG. 5A and FIG. 5B, may include the inner layer 1C between the electro-conductive substrate 1A and the electro-conductive layer 1B. The inner layer may be an elastic layer having electro-conductivity, and the developing member according to the present disclosure may include a single electro-conductive elastic layer or a plurality of electro-conductive elastic layers.

The inner layer has electro-conductivity, and plays a role in imparting elasticity to the member for electrophotography in order to have contact with a moderate area at the time of pressure contact with another member (e.g., a photosensitive drum or a toner regulating member), and to reduce stress on toner.

The same material as that to be used in the electro-conductive layer may be used as a material to be used for the inner layer.

The volume resistivity of the electro-conductive portion in the developing member is preferably $1.0\times10^{2}$ Ω·cm or more and $1.0\times10^{11}$ Ω·cm or less, and hence the addition amount of the carbon black in the inner layer is preferably set as described below. That is, the addition amount is set to preferably 1 part by mass or more and 80 parts by mass or less, more preferably 2 parts by mass or more and 70 parts by mass or less with respect to 100 parts by mass in total of rubber materials.

Further, in the inner layer, another electro-conductive agent may be used in combination with the carbon black as required. Examples of the other electro-conductive agent include the following materials: graphite; various electro-conductive metals or alloys, such as aluminum, copper, tin, and stainless steel; metal oxides each obtained by subjecting tin oxide, zinc oxide, indium oxide, titanium oxide, a tin oxide-antimony oxide solid solution, or the like to any of various treatments for imparting electro-conductivity; and various ionic electro-conductive materials. From the viewpoint of causing the volume resistivity of the electro-conductive portion in the developing member to fall within the above-mentioned range, the addition amount of such other electro-conductive agent is set to preferably 2 parts by mass or more and 20 parts by mass or less, more preferably 5 parts by mass or more and 18 parts by mass or less with respect to 100 parts by mass in total of rubber materials.

In addition, as other additives, ones known in the field of developing members may be appropriately used. Examples of the other additives may include: reinforcing agents, such as hydrophilic silica, hydrophobic silica, quartz, calcium carbonate, aluminum oxide, zinc oxide, and titanium oxide; and heat transfer-improving agents.

<Production Method for Developing Member>

Now, a production method for a roller having a configuration in which a surface portion of the electro-conductive layer that is not covered with the first region and the second region serves as the third region, the method involving forming the inner layer on the circumferential surface of the substrate, then forming the electro-conductive layer, and further forming the first region and the second region on the circumferential surface of the electro-conductive layer, is described.

(Inner Layer Forming Step)

As a production method for arranging the inner layer on the electro-conductive substrate (mandrel), a method known in the field of developing members may be appropriately used. An example thereof is a method subjecting the substrate and a material for forming the inner layer to coextrusion molding. In addition, when the material for forming the inner layer is liquid, an example of the method involves: pouring the material for forming the inner layer into a mold in which a cylindrical pipe, dies configured to hold the substrate, which are arranged at both ends of the pipe, and the substrate are arranged; and curing the material through heating. As described above, the material for forming the inner layer may contain, for example, a rubber material, a resin, an electro-conductive agent, and other additives.

(Electro-Conductive Layer Forming Step)

As a method of forming the electro-conductive layer on the electro-conductive substrate (on the inner layer when the inner layer is present), there is given, for example, a method involving applying a coating liquid obtained by mixing and dispersing, for example, a rubber material or a resin, such as a urethane resin, an electro-conductive agent, such as carbon black, and a solvent with an additive onto the substrate.

When the urethane resin is used, the solvent to be used for the coating liquid may be appropriately selected on the condition that the urethane resin is dissolved (or dispersed). Specific examples of the solvent include: ketones typified by methyl ethyl ketone and methyl isobutyl ketone; hydrocarbons typified by hexane and toluene; alcohols typified by methanol and isopropanol; esters; and water. The solvent is particularly preferably methyl ethyl ketone or methyl isobutyl ketone from the viewpoints of the solubility of the resin and a boiling point.

(Second Region Forming Step)

A method of forming the second region on the electro-conductive layer is not particularly limited. For example, when the second region is formed of a resin, there may be used a method involving dissolving the resin in a solvent, applying the solution onto the electro-conductive layer by a method such as spraying, dipping, or roll coating, and curing the resin through heating or irradiation with ultraviolet light as required. In addition, when metal oxide particles are used, there may be used a method involving forming the second region in the same manner as in the case of the resin, or a method involving, for example, applying the metal oxide particles directly onto the electro-conductive layer, and removing the metal oxide particles applied in excess. When the second region is formed of the resin, after its application onto the electro-conductive layer, part of the electro-conductive layer needs to be exposed, and hence the surface nature of the electro-conductive layer needs to be controlled with a surface modifier or the like so that the resin for forming the second region may be repelled on the electro-conductive layer to some extent after the application. In addition, when the second region is formed of the metal oxide particles, after their application to the electro-conductive layer, the metal oxide particles need to be removed using a wrapping film or the like so as to expose the surface of the electro-conductive layer.

(First Region Forming Step)

A method of forming the first region on the electro-conductive layer is not particularly limited, but for example, the following method may be used: a method involving applying a material (before curing) containing a compound for forming the first region onto the electro-conductive layer or onto the second region in the form of dots through screen printing or with a jet dispenser, and curing (polymerizing) the material through heating or irradiation with ultraviolet light as required; or a method involving applying the above-mentioned insulating material onto the electro-conductive layer or onto the second region through dipping, spraying, roll coating, or the like, intentionally causing the material to be repelled on the electro-conductive layer, and then curing the material through heating or irradiation with ultraviolet light as required.

The material may contain the above-mentioned compound (e.g., a monomer) for forming the first region, a solvent, and an additive, such as a polymerization initiator.

When a thermoplastic resin is used as the material for forming the first region, the thermoplastic resin has a relatively large molecular weight, and hence easily spreads to form a film over the entire surface of the electro-conductive layer. Accordingly, the surface of the electro-conductive layer or the second region cannot be exposed, and the surface state as defined in the present disclosure cannot be formed in some cases. Therefore, in order to facilitate the formation of the predetermined first region, it is preferred to control the wettability of the surface of the electro-conductive layer in advance to repel the thermoplastic resin to some extent after the application of the resin, to thereby facilitate the formation of the first region while exposing the surface of the electro-conductive layer or the second region.

The solvent to be used for the coating liquid may be appropriately selected on the condition that the thermoplastic resin is dissolved therein. Specific examples of the solvent include: ketones typified by methyl ethyl ketone and methyl isobutyl ketone; hydrocarbons typified by hexane and toluene; alcohols typified by methanol and isopropanol; esters; and water. The solvent is particularly preferably a low-boiling point solvent, such as methyl ethyl ketone, from the viewpoint of a need for sufficient drying in the case where curing is subsequently performed using ultraviolet light, and the viewpoint of securing the area of the exposed electro-conductive portion in the formation of the insulating portion at the time of drying.

As a method of controlling the above-mentioned wettability of the surface of the electro-conductive layer, for example, a method involving adding a surface modifier or the like may be used.

(With regard to Formation Order of First Region and Second Region)

With regard to the formation order of the first region and the second region, it is preferred that the second region be formed first, and then the first region be formed in order to cause the second region to be present on the outer edge of the first region and in order to achieve a configuration in which the third region and the second region are adjacent to each other.

<Electrophotographic Image Forming Apparatus and Electrophotographic Process Cartridge>

Figure 6:
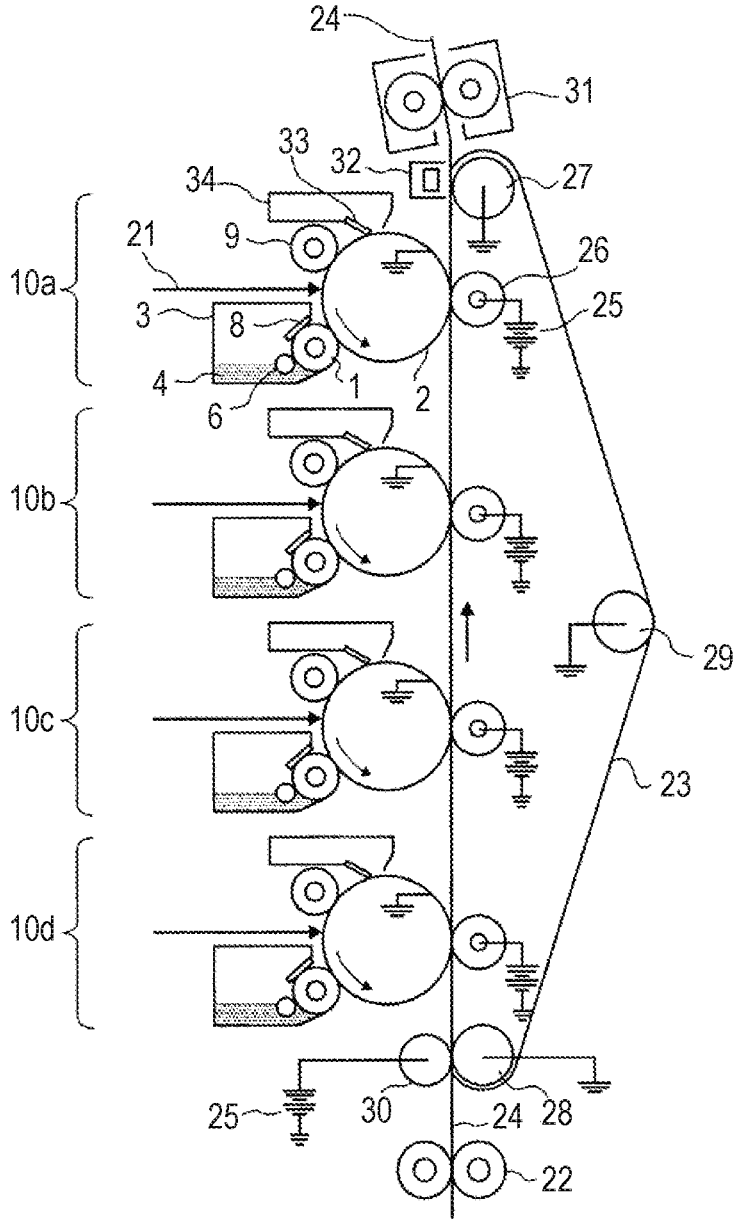
FIG. 6 is a schematic configuration view for illustrating an example of an electrophotographic image forming apparatus according to the present disclosure.

A schematic configuration view of an example of an electrophotographic image forming apparatus (electrophotographic apparatus) in which the developing member according to the present disclosure may be used is illustrated in FIG. 6. The electrophotographic apparatus includes at least the following apparatus and the like. That is, the electrophotographic apparatus includes: an image bearing member configured to bear an electrostatic latent image; a charging apparatus configured to subject the image bearing member to primary charging; an exposing apparatus configured to form an electrostatic latent image on the image bearing member that has been subjected to the primary charging; a developing apparatus configured to develop the electrostatic latent image with toner to form a toner image; and a transfer apparatus configured to transfer the toner image onto a transfer material. A detailed description is given below.

The (color) electrophotographic apparatus illustrated in FIG. 6 includes electrophotographic process cartridges (for respective colors) (10*a* to 10*d*) arranged for respective color toners, i.e., yellow Y, magenta M, cyan C, and black BK in tandem. Each of those electrophotographic process cartridges may be removably mounted onto the main body of the electrophotographic apparatus, and includes a developing member 1 according to the present disclosure as a developing roller. Those process cartridges have the same basic configuration, though their specifications slightly differ from each other depending on the characteristics of the respective color toners. An electrophotographic process cartridge according to the present disclosure may have, for example, the following configuration. That is, the electrophotographic process cartridge may include: an image bearing member, such as a photosensitive drum 2; a charging apparatus including a charging member, such as a charging roller 9; a developing apparatus including a developing member, such as a developing roller 1; and a cleaning apparatus including a cleaning member 33, such as a cleaning blade.

In the electrophotographic apparatus illustrated in FIG. 6, the photosensitive drum 2 is rotated in an arrow direction, and on the periphery thereof, the charging roller 9 configured to uniformly charge the photosensitive drum 2 is arranged. In addition, the electrophotographic apparatus includes: an exposing unit (exposing apparatus) configured to irradiate the uniformly charged photosensitive drum 2 with laser light 21 to form an electrostatic latent image; and the developing apparatus including the developing roller, configured to develop the electrostatic latent image by supplying toner to the photosensitive drum 2 having the electrostatic latent image formed thereon. The electrophotographic apparatus further includes the transfer apparatus including a transfer roller 26 configured to transfer the toner image on the photosensitive drum 2 onto a recording medium (transfer material) 24, such as paper, which is fed by a sheet feeding roller 22 and conveyed by a conveying belt 23, by applying a voltage from a bias power source 25 from the back surface of the recording medium 24. The details of the developing apparatus are described later.

The conveying belt 23 is suspended over a driver roller 27, a driven roller 28, and a tension roller 29, and is controlled to move in synchronization with the respective image forming portions to convey the recording medium 24 so that the toner images formed in the image forming portions may be sequentially transferred onto the recording medium 24 in a superimposed manner. The recording medium 24 is adapted to be conveyed by being electrostatically adsorbed by the conveying belt 23 through the action of an adsorbing roller 30, the roller being arranged immediately before the conveying belt 23.

In the electrophotographic apparatus, the photosensitive drum 2 and the developing roller that is the electrophotographic member (electrophotographic roller) 1 according to the present disclosure are arranged so as to be in contact with each other, and the photosensitive drum 2 and the developing roller rotate in the same direction at the site of contact therebetween. Further, the electrophotographic apparatus includes: a fixing device 31 for fixing the toner images transferred onto the recording medium 24 in a superimposed manner through heating or the like; and a conveying device (not shown) for discharging the recording medium on which the images have been formed to the outside of the apparatus. The recording medium 24 is adapted to be peeled from the conveying belt 23 through the action of a peeling device 32 and then conveyed to the fixing device 31. Further, the electrophotographic apparatus includes a cleaning apparatus having a cleaning blade 33 for removing transfer residual toner remaining on the photosensitive drum 2 without being transferred and a waste toner container 34 for storing toner stripped off the photosensitive drum. The photosensitive drum 2 that has been cleaned is adapted to wait in an image-formable state.

Figure 7:
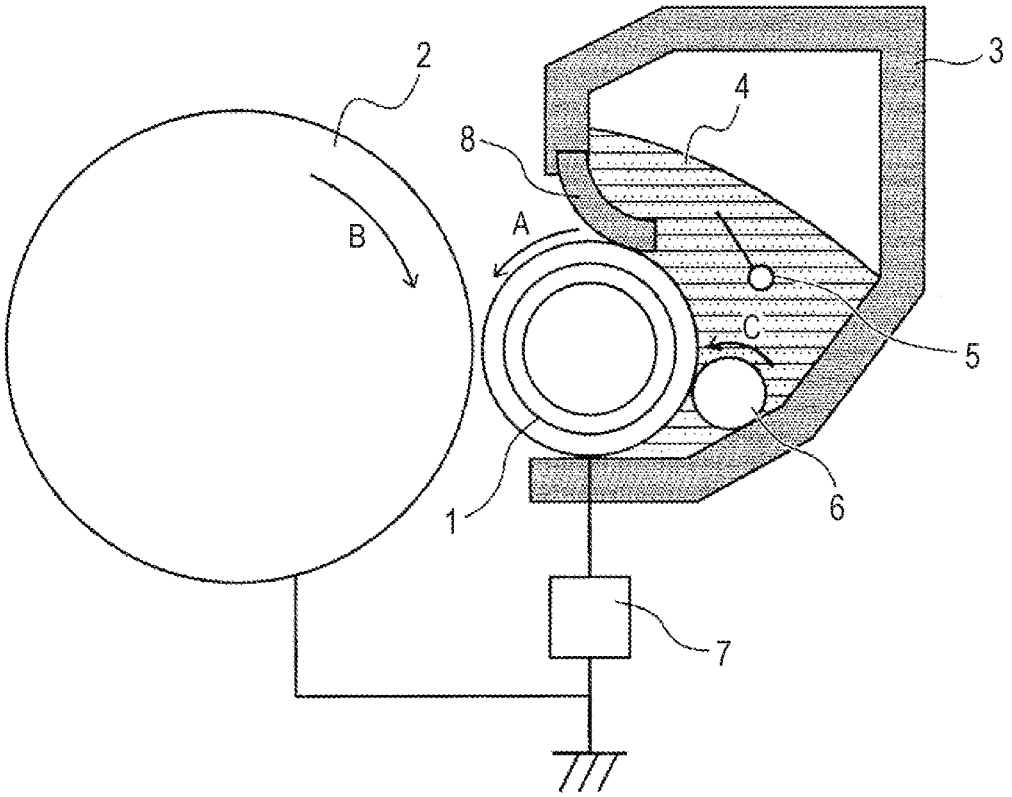
FIG. 7 is a schematic configuration view for illustrating an example of an electrophotographic process cartridge according to the present disclosure.

Subsequently, an example of the developing apparatus is described in detail with reference to FIG. 7. In FIG. 7, the photosensitive drum 2 serving as an electrostatic latent image bearing member for bearing an electrostatic latent image formed by a known process is rotated in an arrow B direction. A stirring blade 5 for stirring a nonmagnetic one-component toner 4 is arranged in the hopper 3 serving as a toner container. A toner-supplying/stripping member (toner-supplying/stripping roller) 6 for supplying the toner 4 to the developing roller serving as the developing member 1 according to the present disclosure and stripping the toner 4 present on the surface of the developing roller after development abuts on the developing roller. When the toner-supplying/stripping roller rotates in the same direction (arrow C direction) as that of the developing roller (arrow A direction), at the site of contact between both the rollers, the surface of the toner-supplying/stripping roller moves in a counter direction against the surface of the developing roller. Thus, the nonmagnetic one-component toner 4 supplied from the hopper 3 is supplied to the developing roller. A developing bias voltage is applied to the developing roller by a developing bias power source 7 in order to move the nonmagnetic one-component toner 4 carried on the developing roller.

The toner supplying/stripping member 6 preferably includes an elastic roller member made of a resin, a rubber, a sponge, or the like. The toner supplying/stripping member 6 is configured to strip toner, which has not been developed and transferred onto the photosensitive drum 2, off the surface of the developing roller for the moment to prevent the occurrence of immobile toner on the developing roller, to thereby enable uniform charging of the toner.

A toner regulating member 8 arranged in the developing apparatus serves as a member configured to regulate the layer thickness of the nonmagnetic one-component toner 4 on the developing roller. The toner regulating member 8 may be formed of a material having rubber elasticity, such as a urethane rubber or a silicone rubber, or a material having metal elasticity, such as phosphor bronze or stainless copper. A thinner toner layer can be formed on the developing roller by bringing the toner regulating member 8 into pressure contact with the developing roller while the toner regulating member 8 is curved in a direction opposite to the rotation direction of the developing roller.

According to one aspect of the present disclosure, the developing member that hardly shows a reduction in toner conveyance amount even when a solid black image or an image having a high print percentage is continuously output can be obtained. According to another aspect of the present disclosure, the electrophotographic process cartridge conducive to stable formation of a high-quality electrophotographic image can be obtained. According to still another aspect of the present disclosure, the electrophotographic image forming apparatus capable of stably forming a high-quality electrophotographic image can be obtained.

EXAMPLES

Now, the present disclosure is specifically described by way of Examples. However, the present disclosure is not limited thereto.

Example 1

<Production of Electro-Conductive Layer>

A solid mandrel made of stainless steel (SUS304) having a diameter of 6 mm was prepared as an electro-conductive substrate. A silane coupling primer (product name: DY35-051, manufactured by Dow Corning Toray Co., Ltd.) was applied to the circumferential surface of the mandrel, and then baked at a temperature of 150° C. for 60 minutes. Next, the mandrel was coaxially arranged in a cylindrical mold, and a gap between the inner peripheral surface of the mold and the circumferential surface of the mandrel was filled with a liquid material for forming an inner layer (material for forming an inner layer) in which materials shown in Table 1 below had been dispersed, followed by heating at a temperature of 140° C. for 20 minutes. After cooling, the mandrel having the material adhering thereto was removed from the mold. Further, the mandrel was heated in an oven heated to a temperature of 200° C. for 4 hours to provide an inner-layer roller 1 having a silicone rubber layer (inner layer) having a thickness of 3 mm on the mandrel.

TABLE 1

| Material | Parts by mass |
|---|---|
| Addition-curable liquid silicone rubber: "XE15-645 A liquid" (product name, Momentive Performance Materials Japan LLC) | 50 |
| Addition-curable liquid silicone rubber: "XE15-645 B liquid" (product name, Momentive Performance Materials Japan LLC) | 50 |
| Carbon black: "DENKA BLACK (powder)" (product name, Denka Company Limited) | 7 |

Next, an electro-conductive layer was arranged on the circumferential surface of the silicone rubber layer (inner layer) of the inner-layer roller 1 as described below. That is, materials shown in Table 2 were weighed out, and methyl ethyl ketone (MEK) was added to these materials, followed by thorough dispersion. The resultant mixture (material for forming an electro-conductive layer) was loaded into an overflow-type circulating applying device. The inner-layer roller 1 was immersed in the applying device and lifted, and then subjected to air drying for 40 minutes, followed by heating at 140° C. for 5 hours. Thus, an electro-conductive elastic roller 1 having arranged thereon an electro-conductive layer having a thickness of 20 μm was produced.

TABLE 2

| Material | Parts by mass |
|---|---|
| Polyol: "P-2010" (product name, manufactured by Kuraray Co., Ltd.) | 75 |
| Isocyanate: "Coronate L-55E" (product name, manufactured by Tosoh Corporation) | 25 |
| Carbon black: "MA100" (product name, manufactured by Mitsubishi ChemicalCorporation) | 20 |
| Urethane resin particles: "C600 Transparent" (product name, manufactured by Negami Chemical Industrial Co., Ltd.) | 22 |

The electro-conductive elastic roller 1 obtained above was attached to an apparatus configured to rotate an electro-conductive elastic roller in its circumferential direction. Then, while the electro-conductive elastic roller 1 was rotated at a rotation speed of 20 ppm, magnesium oxide particles (product name: Kyowamag MF-30, manufactured by Kyowa Chemical Industry Co., Ltd.) were allowed to adhere onto the circumferential surface of the electro-conductive elastic roller 1. Subsequently, a waste cloth made of paper (product name: KIMWIPE S-200, manufactured by Nippon Paper Crecia Co., Ltd.) was used to rub the magnesium oxide particles onto the circumferential surface of the electro-conductive elastic roller 1 to bury the magnesium oxide particles in the outer surface of the electro-conductive layer. Next, while the electro-conductive elastic roller 1 was kept rotating at a rotation speed of 20 rpm, the circumferential surface of the electro-conductive elastic roller 1 was polished with Wrapping Film #8000 (product name, manufactured by 3M Japan Limited) to expose part of the magnesium oxide particles buried in the electro-conductive layer on the outer surface of the electro-conductive elastic roller, and to expose part of the outer surface of the electro-conductive layer. As a result, the outer surface of the electro-conductive elastic roller 1 was formed of part of the electro-conductive layer and part of the magnesium oxide particles. After that, the resultant was heated at a temperature of 80° C. for 2 hours to provide a roller 1 having the second region arranged thereon.

Next, a styrene-acrylic copolymer (product name: Hitaloid HA1470, manufactured by Hitachi Chemical Company, Ltd.) was dissolved in MEK so as to have a solid content concentration of 3%, and the solution was loaded into an overflow-type circulating applying device. The roller 1 having the second region formed thereon was immersed. The roller was lifted, and then subjected to air drying for 40 minutes, followed by heating at a temperature of 90° C. for 1 hour. Thus, a developing roller 1 was obtained.

(Confirmation of First Region, Second Region, and Third Region)

The obtained developing roller was evaluated for the respective regions as described below.

First, the outer surface of the developing roller 1 was observed with a laser microscope (product name: VK-8710, manufactured by Keyence Corporation) at a magnification of 500×. As a result, it was confirmed that the first region, the second region, and the third region were present in the surface of the developing roller 1, and the second region was present on the outer edge of the first region. Specifically, the third region was formed of the outer surface of the electro-conductive layer serving as the outer surface of the electro-conductive layer and forming the outer surface of the developing roller. In addition, the second region was formed of exposed portions of the magnesium oxide particles held by the electro-conductive layer so that at least part thereof were exposed on the outer surface of the developing roller. Further, the first region was formed of a layer of the styrene-acrylic copolymer formed so as to surround the peripheries of the exposed portions of the magnesium oxide particles. The reason why the first region is formed so as to surround the exposed portions of the magnesium oxide particles is presumably because the solution of the styrene-acrylic copolymer was repelled at the exposed portion of the electro-conductive layer and the exposed portions of the magnesium oxide particles to accumulate at an interface between the outer surface of the electro-conductive layer and each of the magnesium oxide particles.

(Measurement of coverage ratios of first region and second region, and ratio at which third region is exposed (hereinafter referred to as exposure ratio))

The coverage ratios of the first region and the second region, and the exposure ratio of the third region were determined using the above-mentioned laser microscope as described below. That is, 30 sites on the outer surface of the developing roller 1 were observed at a magnification of 500×, and were each determined for the coverage ratios of the first region and the second region, and the exposure ratio of the third region, and the average value of the 30 sites was defined as each of the coverage ratios of the first region and the second region, and the exposure ratio of the third region. The results were as follows: the coverage ratio of the first region was 29%, the coverage ratio of the second region was 36%, and the exposure ratio of the third region was 35%.

(Measurement of Average Heights of First Region and Second Region)

The developing roller 1 was cut into a semi-cylindrical shape so as to allow cross-sectional observation. The cut-out rubber piece was set on a sample stand so as to allow the cross-section of the developing roller 1 to be observed, and was observed using a scanning electron microscope (product name: S-3700N, manufactured by Hitachi High-Technologies Corporation), and the thicknesses of the first region and the second region were measured. The thickness of each region was measured at 30 sites, and the average values of the measured thicknesses were defined as the thicknesses of the first region and the second region. The results were as follows: the average height of the first region was 1.4 μm, and the average height of the second region was 0.8 μm.

(Measurement of Surface Potentials of First Region, Second Region, and Third Region)

A cross-section including the first region, the second region, and the third region was cut out of the developing roller 1 that had been left to stand under an environment having a temperature of 23° C. and a humidity of 50% for 24 hours in advance. A voltage of 4.5 V was applied to the cut-out cross-section with a scanning probe microscope (product name: MFP-3D-Origin, manufactured by Oxford Instruments KK) at a distance of 90 nm from a probe. 20 points each having a high surface potential and 20 points each having a low surface potential were sampled from the resultant surface potential image, and the average thereof was determined as a surface potential. Thus, the surface potentials of the first region, the second region, and the third region were obtained. The surface potentials of the first region, the second region, and the third region of the developing roller 1 were −0.70 V, −0.54 V, and 0.50 V, respectively.

(Measurement of Volume Resistivity of First Region-forming Material)

A sample including the first region was cut out of the developing roller 1, and a microtome was used to produce a thin-slice sample having a plane size of 50 μm square and a thickness t of 100 nm. Next, the thin-slice sample was placed on a flat metal plate, and a metal terminal having a pressing surface area S of 100 $\mu m^2$ was pressed against the first region of the thin-slice sample from above. Under this state, a voltage of 1 V was applied between the metal terminal and the flat metal plate with an electrometer 6517B of Keithley Instruments, Inc. to determine resistance R, and a volume resistivity pv (Ω·cm) was calculated from the resistance R by the following equation.

$$pv = R \times S/t$$

The same operation was performed for three samples, and the three-point arithmetic average value of the volume resistivity pv was determined. The resultant arithmetic average of the volume resistivity pv was defined as the volume resistivity of the first region.

The resultant volume resistivity was $1.2 \times 10^{13}$ Ω·cm.

(Evaluation as Developing Roller)

Evaluation I) Evaluation of Image Density Difference

Next, the developing roller 1 according to Example 1 was mounted onto a modified process cartridge for a color laser printer (product name: HP Color LaserJet Enterprise M652dn, manufactured by HP). The modified process cartridge used was obtained by reducing the outer diameter of a toner supplying/stripping member by 1 mm and reducing a rotation speed by 20%. The process cartridge was mounted onto the color laser printer, and the whole was left to stand under an environment having a temperature of 23° C. and a humidity of 50% for 24 hours. After that, a solid black image was output on 1 sheet, and then the solid black image was continuously output on 100 sheets. Further, the solid black image was output on 1 sheet. For each of the first output solid black image and the final output solid black image, measurement was performed at 10 sites (vertical)×5 sites (horizontal), i.e., a total of 50 sites in the solid black image through use of a spectral densitometer: X-Rite 504 (product name, S.D.G K.K.), and the average of the measured values at the 50 sites was defined as a solid black image density. A difference in density between the first and final solid black images was determined, and evaluation was performed based on the following criteria.

Rank A: The difference in image density is 0.10 or less.

Rank B: The difference in image density is more than 0.10 and 0.15 or less.

Rank C: The difference in image density is more than 0.15 and 0.20 or less.

Rank D: The difference in image density is more than 0.20 and 0.25 or less.

Rank E: The difference in image density is more than 0.25 and 0.30 or less.

Rank F: The difference in image density is more than 0.30.

Evaluation II) Evaluation of Toner Conveyance Amount

Figure 8:
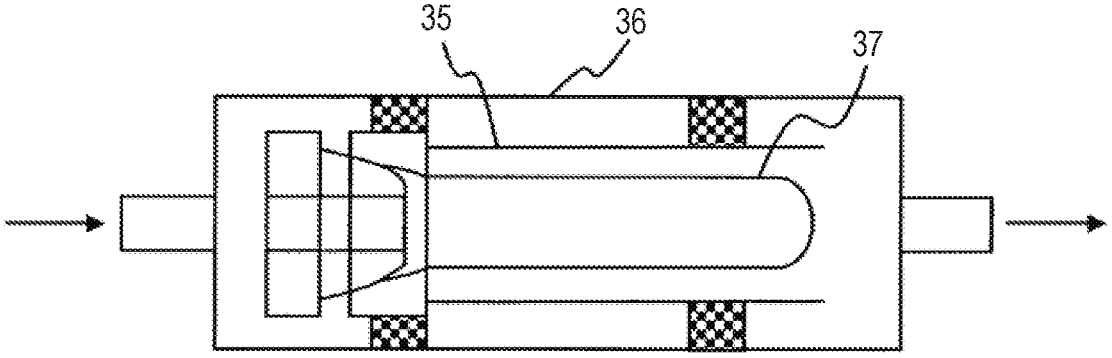
FIG. 8 is a schematic configuration view of a jig to be used in the measurement of a toner conveyance amount.

Under the same conditions as in the evaluation of the image density difference, before and after the continuous output of the solid black image on 100 sheets in the evaluation of the image density difference using the color laser printer, the power source of the color laser printer was turned off during the output of the solid black image, and the process cartridge was removed. Next, such a jig formed of an outer cylinder 36, an inner cylinder 35, and a cylindrical paper filter 37 (product name: Cylindrical Paper Filter No. 86R, manufactured by ADVANTEC) as illustrated in FIG. 8 was attached to a vacuum cleaner, and toner on the developing roller mounted onto the process cartridge was sucked into the cylindrical paper filter. The vacuum cleaner was attached on the right of the drawing sheet of FIG. 8, and the toner was sucked from the left of the drawing sheet. Then, the mass of the sucked toner was measured, and a toner amount per unit area on the developing roller was determined as a toner conveyance amount ($mg/cm^2$). A difference between the toner conveyance amount before the output of the solid black image on 100 sheets and the toner conveyance amount after the output of the solid black image on 100 sheets was calculated to determine the difference in toner conveyance amount, and evaluation was performed based on the following criteria.

Rank A: The difference in toner conveyance amount is 0.05 or less.

Rank B: The difference in toner conveyance amount is more than 0.05 and 0.10 or less.

Rank C: The difference in toner conveyance amount is more than 0.10 and 0.15 or less.

Rank D: The difference in toner conveyance amount is more than 0.15 and 0.20 or less.

Rank E: The difference in toner conveyance amount is more than 0.20 and 0.25 or less.

Rank F: The difference in toner conveyance amount is more than 0.25.

Example 2

A developing roller 2 was produced in the same manner as in Example 1 except that materials shown in Table 3 below were used as materials for forming the second region.

TABLE 3

| Material | Parts by mass |
|---|---|
| Magnesium oxide (product name: Kyowamag MF-30, manufactured by Kyowa Chemical Industry Co., Ltd.) | 90 |
| Tin oxide (product name: 6010, manufactured by Mitsui Mining & Smelting Co., Ltd.) | 10 |

Example 3

The second region was formed on the electro-conductive elastic roller 1 using materials shown in Table 4 below as materials for forming the second region. Thus, a roller 3 was produced.

TABLE 4

| Material | Parts by mass |
|---|---|
| Magnesium oxide (product name: Kyowamag MF-30, manufactured by Kyowa Chemical Industry Co., Ltd.) | 97 |
| Tin oxide (product name: 6010, manufactured by Mitsui Mining & Smelting Co., Ltd.) | 3 |

Next, the first region was formed on the roller 3 using materials shown in Table 5 below as first region-forming materials.

TABLE 5

| Material | Parts by mass |
|---|---|
| Silicone resin (first region-forming material) methyl group-containing oligomer (product name: X-40-8225, manufactured by Shin-Etsu Chemical Co., Ltd.) | 100 |
| Curing catalyst: titanium-based curing catalyst (product name: D50, manufactured by Shin-Etsu Chemical Co., Ltd.) | 5 |

Specifically, the materials shown in Table 5 above were weighed out, and MEK was added so that the solid content concentration of the silicone resin was 3%. The materials were thoroughly dissolved. The resultant mixture was loaded into an overflow-type circulating applying device. The roller 3 was immersed in the applying device and lifted, and then subjected to air drying for 40 minutes, followed by heating at 150° C. for 2 hours. Thus, a developing roller 3 was produced.

Example 4

A developing roller 4 was produced in the same manner as in Example 3 except that the materials shown in Table 3 were used as materials for forming the second region.

Example 5

The second region was formed on the electro-conductive elastic roller 1 using materials shown in Table 6 below as materials for forming the second region. Thus, a roller 5 was produced.

TABLE 6

| Material | Parts by mass |
|---|---|
| Magnesium oxide (product name: Kyowamag MF-30, manufactured by Kyowa Chemical Industry Co., Ltd.) | 91 |
| Tin oxide (product name: 6010, manufactured by MitsuiMining & Smelting Co., Ltd.) | 9 |

Next, the first region was formed on the roller 5 using materials shown in Table 7 below as materials for forming the first region.

TABLE 7

| Material | Parts by mass |
|---|---|
| Acrylic compound (first region-forming material) rosin epoxy -based acrylate (product name: Beamset 101, manufactured by Arakawa Chemical Industries, Ltd.) | 100 |
| Polymerization initiator: 1-hydroxy -cyclohexyl phenyl ketone (polymerization initiator: Omnirad 184, manufactured by IGM Resins) | 5 |

Specifically, the materials shown in Table 7 above were weighed out, and MEK was added so that the solid content concentration of the acrylic compound was 3%. The materials were thoroughly dissolved. The resultant mixture was loaded into an overflow-type circulating applying device. The roller 5 was immersed in the applying device and lifted, and then subjected to air drying for 40 minutes, followed by heating at 90° C. for 1 hour. After that, the surface of the roller having the mixture adhering thereto was irradiated with ultraviolet light so as to achieve a cumulative light quantity of 2,200 mJ/cm$^2$, to thereby cure the above-mentioned component. Thus, a developing roller 5 was obtained. As an ultraviolet irradiation device, a UV curing device (product name: Handy-type UV Curing Device "MDH2501-02", lamp type: metal halide (Fe/Ga)/high-pressure mercury lamp, main wavelength: continuous wavelength of from 250 nm to 450 nm, lamp wattage: 250 W; manufactured by Marionetwork) was used.

Example 6

A developing roller 6 was produced in the same manner as in Example 1 except that the materials shown in Table 6 were used as materials for forming the second region.

Example 7

A developing roller 7 was produced in the same manner as in Example 3 except that the materials shown in Table 6 were used as materials for forming the second region.

Example 8

A developing roller 8 was produced in the same manner as in Example 5 except that magnesium oxide (product name: Kyowamag MF-30, manufactured by Kyowa Chemical Industry Co., Ltd.) was used as a material for forming the second region.

Example 9

A developing roller 9 was produced in the same manner as in Example 5 except that the materials shown in Table 4 were used as materials for forming the second region.

Example 10

A polysilazane (product name: PHPS, manufactured by Exousia Inc.) was used as a material for forming the first region. Specifically, a solution of the polysilazane in MEK was loaded into an overflow-type circulating applying device. The roller 1 was immersed in the applying device and lifted, and then subjected to air drying for 40 minutes, followed by heating under an environment having a temperature of 80° C. and a humidity of 95% for 2 hours. Except for the foregoing, a developing roller 10 was produced in the same manner as in Example 1. The polysilazane forms silicon oxide (silica) after reaction.

Example 11

A developing roller 11 was produced in the same manner as in Example 1 except that a polyester resin (product name: VYLON 200, manufactured by Toyobo Co., Ltd.) was used as a material for forming the first region.

Example 12

A developing roller 12 was produced in the same manner as in Example 1 except that silicon oxide (product name: KE-P30, manufactured by Nippon Shokubai Co., Ltd.) was used as a material for forming the second region.

Example 13

A developing roller 13 was produced in the same manner as in Example 3 except that titanium oxide (product name: SA-1, manufactured by Sakai Chemical Industry Co., Ltd.) was used as a material for forming the second region.

Example 14

A developing roller 14 was produced in the same manner as in Example 1 except that zinc oxide (product name: F-1, manufactured by Hakusui Tech Co., Ltd.) was used as a material for forming the second region.

Example 15

A developing roller 15 was produced in the same manner as in Example 3 except that strontium titanate (product name, manufactured by Adachi New Industrial Companies) was used as a material for forming the second region.

Example 16

A developing roller 16 was produced in the same manner as in Example 3 except that silicon oxide (product name: KE-P30, manufactured by Nippon Shokubai Co., Ltd.) was used as a material for forming the second region.

Example 17

A developing roller 17 was produced in the same manner as in Example 11 except that silicon oxide (product name: KE-P30, manufactured by Nippon Shokubai Co., Ltd.) was used as a material for forming the second region.

Example 18

A developing roller 18 was produced in the same manner as in Example 3 except that acrylic particles (product name: Fine Sphere FS-201, manufactured by Nipponpaint Industrial Coatings Co., Ltd.) were used as a material for forming the second region.

Comparative Example 1

The second region was arranged on the electro-conductive elastic roller 1 using materials shown in Table 8 below as materials for forming the second region. Thus, a roller 19 was produced.

TABLE 8

| Material | Parts by mass |
|---|---|
| Magnesium oxide (product name: Kyowamag MF-30, manufactured by Kyowa Chemical Industry Co., Ltd.) | 95 |
| Tin oxide (product name: 6010, manufactured by Mitsui Mining & Smelting Co., Ltd.) | 5 |

Next, the first region was formed on the roller 19 using ditrimethylolpropane tetraacrylate (product name: AD-TMP, manufactured by Shin-Nakamura Chemical Co., Ltd.) as a material for forming the first region. Except for the foregoing, a developing roller 19 was produced in the same manner as in Example 5.

Comparative Example 2

A developing roller 20 was produced in the same manner as in Example 3 except that materials shown in Table 9 were used as materials for forming the second region.

TABLE 9

| Material | Parts by mass |
|---|---|
| Magnesium oxide (product name: Kyowamag MF-30, manufactured by Kyowa Chemical Industry Co., Ltd.) | 98 |
| Tin oxide (product name: 6010, manufactured by Mitsui Mining & Smelting Co., Ltd.) | 2 |

Comparative Example 3

A developing roller 21 was produced in the same manner as in Example 5 except that the materials shown in Table 3 were used as materials for forming the second region.

Comparative Example 4

A developing roller 22 was produced in the same manner as in Example 3 except that the second region was not formed.

Each of the developing rollers obtained in Examples 2 to 18 and Comparative Examples 1 to 3 described above was evaluated in the same manner as in Example 1.

The materials for forming the first region and the second region of the developing rollers according to Examples 1 to 18 and Comparative Examples 1 to 4 are summarized in Table 10. In addition, the evaluation results are shown in Table 11.

TABLE 10

| | | Materials for forming regions | |
|---|---|---|---|
| | | First region | Second region |
| Example | 1 | Styrene-acrylic copolymer | Magnesium oxide |
| | 2 | Styrene-acrylic copolymer | Magnesium oxide/tin oxide = 90/10 |
| | 3 | Silicone resin | Magnesium oxide/tin oxide = 97/3 |
| | 4 | Silicone resin | Magnesium oxide/tin oxide = 90/10 |
| | 5 | Epoxy acrylic | Magnesium oxide/tin oxide = 91/9 |
| | 6 | Styrene-acrylic copolymer | Magnesium oxide/tin oxide = 91/9 |
| | 7 | Silicone resin | Magnesium oxide/tin oxide = 91/9 |
| | 8 | Epoxy acrylic | Magnesium oxide |
| | 9 | Epoxy acrylic | Magnesium oxide/tin oxide = 97/3 |
| | 10 | Silica | Magnesium oxide |
| | 11 | PET | Magnesium oxide |
| | 12 | Styrene-acrylic copolymer | Silicon oxide |
| | 13 | Silicone resin | Titanium oxide |
| | 14 | Styrene-acrylic copolymer | Zinc oxide |
| | 15 | Silicone resin | Strontium titanate |
| | 16 | Silicone resin | Silicon oxide |
| | 17 | PET | Silicon oxide |
| | 18 | Silicone resin | Acrylic resin particles |
| Comparative Example | 1 | Ditrimethylolpropane tetra-acrylate cured product | Magnesium oxide/tin oxide = 95/5 |
| | 2 | Silicone resin | Magnesium oxide/tin oxide = 98/2 |
| | 3 | Epoxy acrylic | Magnesium oxide/tin oxide = 90/10 |
| | 4 | Silicone resin | — |

TABLE 11

| | | Volume resistivity (Ω· cm) | Surface potential (V) | | | V1/ | Evaluation I | Evaluation II |
|---|---|---|---|---|---|---|---|---|
| | | First region | V1 | V2 | V3 | V2 | Evaluation rank | Evaluation rank |
| Example | 1 | $1.2 \times 10^{15}$ | −0.70 | −0.54 | 0.50 | 1.30 | C | C |
| | 2 | $1.2 \times 10^{15}$ | −0.69 | −0.03 | 0.40 | 23.00 | C | C |
| | 3 | $2.1 \times 10^{13}$ | −0.51 | −0.38 | 0.10 | 1.34 | C | C |
| | 4 | $2.1 \times 10^{13}$ | −0.50 | −0.02 | 0.20 | 25.00 | C | C |
| | 5 | $3.4 \times 10^{14}$ | −0.59 | −0.06 | 0.30 | 9.83 | C | C |
| | 6 | $1.2 \times 10^{15}$ | −0.68 | −0.06 | 0.50 | 11.33 | C | C |
| | 7 | $2.1 \times 10^{13}$ | −0.51 | −0.06 | 0.10 | 8.50 | C | C |
| | 8 | $3.4 \times 10^{14}$ | −0.61 | −0.03 | 0.30 | 20.33 | C | C |
| | 9 | $3.4 \times 10^{14}$ | −0.59 | −0.38 | 0.30 | 1.55 | C | C |
| | 10 | $2.8 \times 10^{16}$ | −0.69 | −0.52 | 0.40 | 1.33 | B | B |
| | 11 | $1.9 \times 10^{16}$ | −0.69 | −0.51 | 0.40 | 1.35 | A | A |
| | 12 | $1.2 \times 10^{15}$ | −0.68 | −0.51 | 0.50 | 1.33 | B | B |
| | 13 | $2.1 \times 10^{13}$ | −0.52 | −0.03 | 0.10 | 17.33 | B | B |
| | 14 | $3.4 \times 10^{14}$ | −0.59 | −0.05 | 0.30 | 11.80 | B | B |
| | 15 | $2.1 \times 10^{13}$ | −0.51 | −0.03 | 0.40 | 17.00 | B | B |
| | 16 | $2.1 \times 10^{13}$ | −0.68 | −0.51 | 0.20 | 1.33 | B | B |
| | 17 | $1.9 \times 10^{16}$ | −0.69 | −0.52 | 0.50 | 1.33 | A | A |
| | 18 | $2.1 \times 10^{13}$ | −0.69 | −0.52 | 0.50 | 1.33 | D | D |
| Comparative Example | 1 | $7.3 \times 10^{12}$ | −0.47 | −0.30 | 0.10 | 1.57 | E | E |
| | 2 | $2.1 \times 10^{13}$ | −0.52 | −0.47 | 0.05 | 1.11 | E | E |
| | 3 | $3.4 \times 10^{14}$ | −0.58 | −0.02 | 0.03 | 29.00 | E | E |
| | 4 | $2.1 \times 10^{13}$ | −0.51 | — | 0.02 | — | F | F |

In each of Examples 1 to 18, the first region, the second region, and the third region were formed on the outer surface of the developing member so as to satisfy the predetermined requirements of the present disclosure.

That is, each of the developing rollers of Examples satisfied the following relationship: when the surface potentials of the first region, the second region, and the third region were represented by V1, V2, and V3, respectively, V1 was −0.70 V or more and −0.50 V or less, V1 and V2 satisfied $1.30 \leq V1/V2 \leq 25.00$, and V3 was 0.00 V or more and 0.50 V or less. As a result, a surface potential difference was generated in each of the first region, the second region, and the third region. Further, gradient forces were generated at adjacent portions of the regions. Accordingly, the ability to convey toner was able to be maintained, and hence the density of the solid black image was able to be maintained even when the solid black image was continuously output.

In each of Examples 10 and 11, a developing roller in which the volume resistivity of a material for forming the first region was high as compared to Examples 1 to 9 was produced. As a result, a larger gradient force was generated, and the solid black image density was able to be maintained. In particular, in Example 11, the use of a resin as a material for forming the first region facilitated the formation of the first regions at a certain interval as compared to Example 10 in which a metal oxide was used. Accordingly, the number of sites adjacent to the second region was able to be further increased, with the result that gradient force generation sites were able to be increased. As a result, the solid black image density was able to be maintained.

In each of Examples 12 to 17, a developing roller using a specific metal oxide as a material for forming the second region was produced. As a result, in triboelectric charging with toner, the high volume resistivity of the metal oxide facilitated the charging in the second region, with the result that the solid black image density was able to be maintained.

In each of Examples 1 to 17, a metal oxide was used as a material for forming the second region as compared to Example 18. As a result, the solid black image density was able to be maintained to a higher degree.

Meanwhile, in each of Comparative Examples 1 to 3, the first region, the second region, and the third region were formed on the outer surface of the developing member, but the surface potentials of the regions of the developing roller fell within ranges different from those in Examples.

As a result, in Comparative Example 1, although surface potential differences were generated between the regions, the surface potential of the first region having the highest surface potential was low, and hence the gradient force generated in each region was reduced. Accordingly, the solid black image density was not able to be maintained.

In each of Comparative Examples 2 and 3, the surface potential V2 in the second region had small differences from the surface potentials V1 and V3 of the first region and the third region. As a result, the surface potential differences were small, and gradient force generation sites were decreased. Accordingly, the solid black image density was not able to be maintained.

In addition, in Comparative Example 4, the second region was not formed. As a result, gradient force generation sites were fewer as compared to Examples 1 to 18, and hence the solid black image density was not able to be maintained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2018-224643, filed Nov. 30, 2018, and No. 2019-205511, filed Nov. 13, 2019, which are hereby incorporated by reference herein in their entirety.

What is claimed is:

1. A developing member comprising:

an electro-conductive substrate; and an electro-conductive layer on the substrate, wherein an outer surface of the developing member includes a first region, a second region, and a third region, wherein, when surface potentials of the first region, the second region, and the third region are measured with a scanning probe microscope provided with a probe by applying a voltage of 4.5 V to the probe under an environment having a temperature of 23° C. and a relative humidity of 50%, the probe being disposed so that distances between the probe and surfaces of the first, the second and the third regions are 90 nm, and measured surface potentials of the first region, the second region and the third region are defined as V1, V2, and V3, respectively, V1 is −0.70 V to −0.50 V;

V1 and V2 satisfy a relationship of $1.30 \leq V1/V2 \leq 25.00$, and

V3 is 0.00 to 0.50 V, and wherein the developing member has a portion in which the first region, the second region, and the third region are adjacent to each other in this order.

2. The developing member according to claim 1, wherein the second region is constituted by a metal oxide particle present on a surface of the electro-conductive layer on an opposite side to a side opposed to the substrate.

3. The developing member according to claim 2, wherein the metal oxide particle comprises at least one selected from the group consisting of silicon oxide particles, titanium oxide particles, zinc oxide particles, and strontium titanate particles.

4. The developing member according to claim 1, wherein the first region is constituted by an electrically insulating portion on a surface of the electro-conductive layer on an opposite side to a side opposed to the substrate.

5. The developing member according to claim 4, wherein the electrically insulating portion contains a resin.

6. The developing member according to claim 1, wherein the third region is constituted by a part of a surface of the electro-conductive layer on an opposite side to a side opposed to the substrate.

7. An electrophotographic process cartridge to be removably mounted onto a main body of an electrophotographic image forming apparatus, the electrophotographic process cartridge comprising a developing member, wherein the developing member includes an electro-conductive substrate and an electro-conductive layer on the substrate, wherein an outer surface of the developing member includes a first region, a second region, and a third region, wherein, when surface potentials of the first region, the second region, and the third region are measured with a scanning probe microscope provided with a probe by applying a voltage of 4.5 V to the probe under an environment having a temperature of 23° C. and a relative humidity of 50%, the probe being disposed so that distances between the probe and surfaces of the first, second and third regions, are 90 nm, and measured surface potentials of the first, the second and the third regions are defined as V1, V2, and V3, respectively, V1 is −0.70 V to −0.50 V;

V1 and V2 satisfy a relationship of $1.30 \leq V1/V2 \leq 25.00$, and

V3 is 0.00 V to 0.50 V, and wherein the developing member has a portion in which the first region, the second region, and the third region are adjacent to each other in this order.

8. An electrophotographic image forming apparatus comprising a developing member, the developing member comprising:

an electro-conductive substrate; and an electro-conductive layer on the substrate, wherein an outer surface of the developing member includes a first region, a second region, and a third region, wherein, when surface potentials of the first region, the second region, and the third region are measured with a scanning probe microscope provided with a probe by applying a voltage of 4.5 V to the probe under an environment having a temperature of 23° C. and a relative humidity of 50%, the probe being disposed so that distances between the probe and surfaces of the first, the second and the third regions are 90 nm, and measured surface potential of the first, the second and the third regions are defined as V1, V2, and V3, respectively, V1 is −0.70 V to −0.50 V;

V1 and V2 satisfy a relationship of $1.30 \leq V1/V2 \leq 25.00$, and

V3 is 0.00 V to 0.50 V, and wherein the developing member has a portion in which the first region, the second region, and the third region are adjacent to each other in this order.

* * * * *